US007124689B2

(12) United States Patent
Davis et al.

(10) Patent No.: US 7,124,689 B2
(45) Date of Patent: Oct. 24, 2006

(54) METHOD AND APPARATUS FOR AUTONOMOUS DETONATION DELAY IN MUNITIONS

(75) Inventors: Martin R. Davis, Champlin, MN (US); Carl Nelson, Minnetonka, MN (US); Mark J. Tomes, Plymouth, MN (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

(21) Appl. No.: 10/994,754

(22) Filed: Nov. 22, 2004

(65) Prior Publication Data

US 2006/0107862 A1 May 25, 2006

(51) Int. Cl.
*F42C 19/06* (2006.01)

(52) U.S. Cl. ..... 102/216; 102/215

(58) Field of Classification Search ..... 102/216, 102/265, 266, 271, 272, 215
See application file for complete search history.

(56) References Cited

U.S. PATENT DOCUMENTS

| | | | | |
|---|---|---|---|---|
| 3,750,583 | A * | 8/1973 | White et al. | 102/221 |
| 4,214,533 | A | 7/1980 | Fine et al. | |
| 4,513,664 | A | 4/1985 | Edmonds | |
| 4,580,498 | A | 4/1986 | Abt et al. | |
| 4,694,752 | A | 9/1987 | Titus | |
| 5,076,511 | A | 12/1991 | Stein et al. | |
| 5,115,742 | A | 5/1992 | Frazer | |
| 5,157,221 | A | 10/1992 | Ronn | |
| 5,198,615 | A | 3/1993 | Robbie et al. | |
| 5,275,107 | A | 1/1994 | Weber et al. | |
| 5,303,654 | A | 4/1994 | Held | |
| 5,390,604 | A | 2/1995 | Ingersoll | |
| 5,497,704 | A | 3/1996 | Kurschner et al. | |
| 5,585,592 | A | 12/1996 | Stearns et al. | |
| 5,596,166 | A | 1/1997 | Gould | |
| 5,705,766 | A | 1/1998 | Farace et al. | |
| 5,914,459 | A | 6/1999 | Teske et al. | |
| 6,065,403 | A | 5/2000 | Haglund | |
| 6,151,563 | A | 11/2000 | Marinelli | |
| 6,163,021 | A | 12/2000 | Mickelson | |
| 6,175,178 | B1 | 1/2001 | Tupper et al. | |
| 6,433,533 | B1 | 8/2002 | Clymer et al. | |
| 6,556,896 | B1 | 4/2003 | Meyer | |
| 6,598,533 | B1 | 7/2003 | Kolbli | |
| 6,750,576 | B1 | 6/2004 | Ehrhart et al. | |
| 2002/0073869 | A1 | 6/2002 | Tieman et al. | |

* cited by examiner

*Primary Examiner*—Stephen M. Johnson
*Assistant Examiner*—Gabriel Klein
(74) *Attorney, Agent, or Firm*—TraskBritt

(57) ABSTRACT

A detonation timing apparatus and method of determining a detonation time is disclosed. The detonation timing apparatus comprises an initiation sensor, at least one impact sensor, and at least one controller. The at least one controller may be configured for sensing an initiation event associated with the initiation sensor and sensing an impact event associated with the at least one impact sensor. The at least one controller is further configured for determining an impact velocity estimate proportional to a temporal difference between the initiation event and the impact event, using the impact velocity estimate to determine the detonation delay, and generating the detonation event at the detonation delay after the impact event. The timing apparatus and method of determining a detonation time may be incorporated in a fuze, which may be incorporated in an explosive projectile.

39 Claims, 4 Drawing Sheets

METHOD AND APPARATUS FOR AUTONOMOUS DETONATION DELAY IN MUNITIONS

CROSS REFERENCE TO RELATED APPLICATIONS

The present application is related to concurrently filed U.S. patent application Ser. No. 10/994,497 entitled METHOD AND APPARATUS FOR SPIN SENSING IN MUNITIONS.

BACKGROUND OF THE INVENTION

1. Field of the Invention

This invention relates generally to fuzes for explosive devices and more particularly to determining a detonation time related to when an explosive device impacts with a target.

2. Description of Related Art

Explosive projectiles must be capable of being handled safely under considerable stress and environmental conditions. In addition, explosive projectiles must be capable of detonating at the proper time. Depending on the application, this proper time may be before impact, at a specific point during flight, during impact, or at some time delay after impact. As used herein the terms "warhead," "explosive device," and "explosive projectile" are generally used to refer to a variety of projectile type explosives, such as, for example, artillery shells, rockets, bombs, and other weapon warheads. In addition, these explosive projectiles may be launched from a variety of platforms, such as, for example, fixed wing aircraft, rotary wing aircraft (e.g., helicopters), ground vehicles, and stationary ground locations. To determine the proper detonation time, these explosive projectiles frequently employ fuzes.

A fuze subsystem activates the explosive projectile for detonation in the vicinity of the target. In addition, the fuze maintains the explosive projectile in a safe condition during logistical and operational phases prior to launch and during the first phase of the launch until the explosive projectile has reached a safe distance from the point of launch. In summary, major functions that a fuze performs are; keeping the weapon safe, arming the weapon when it is a safe distance from the point of launch, detecting the target, and initiating detonation of the warhead at some definable point after target detection.

The first two functions of keeping the weapon safe and arming the weapon are conventionally referred to as Safing and Arming (S&A). Safing and Arming devices isolate a detonator from the warhead booster charge until the explosive projectile has been launched and a safe distance from the launch vehicle is achieved. At that point, the S&A device removes a physical barrier from, or moves the detonator in line with, the explosive train, which effectively arms the warhead so it can initiate detonation at the appropriate time.

Some S&A devices function by measuring elapsed time from launch, others determine distance traveled from the launch point by sensing acceleration experienced by the weapon. Still other devices sense air speed or projectile rotation. For maximum safety and reliability of a fuze, the sensed forces or events must be unique to the explosive projectile when deployed and launched, not during ground handling or pre-launch operations. Most fuzes must determine two independent physical parameters before determining that a launch has occurred and a safe separation distance has been reached.

The last two functions conventionally performed by a fuze of detecting the target and initiating detonation may depend on target type, explosive projectile type, and tactical operational decisions. Target detection may occur using a simple timer, determining a predetermined time after launch, using sensors to detect proximity to a target, or using sensors to detect impact with a target. Conventionally, impact fuzes, as opposed to proximity fuzes, are designed to detect the target by sensing some type of impact or contact with a target.

In an impact fuze, the final fuze function of initiating detonation of the warhead may occur as temporally close to impact as possible or may be delayed for a certain period of time allowing the warhead to penetrate the target prior to detonation. Conventionally, delayed detonation has been performed by defining a fixed delay after impact to initiate detonation. However, generally there may be an optimum penetration depth at which the warhead should detonate. A fixed delay may cause the warhead to detonate significantly earlier than or later than this optimum penetration depth is reached. In addition, the impact event may be the only parameter available for determining the fixed delay. When impact is the only event parameter available, the impact velocity is conventionally unknown.

If the impact velocity were known, a penetration delay proportional to the impact velocity could by incorporated to optimize the penetration delay and, as a result, detonate the warhead at a depth closer to the optimum penetration depth. There is a need for an apparatus and method for generating an impact velocity estimate and for determining a more optimum delay time in which to detonate an explosive projectile after impact with a target.

BRIEF SUMMARY OF THE INVENTION

An embodiment of the present invention comprises a detonation timing apparatus configured to determine an impact velocity estimate, which is used for determining a detonation delay that will generate a detonation event at a more optimum penetration depth. The detonation timing apparatus comprises an initiation sensor, at least one impact sensor, and at least one controller. The at least one controller is configured for sensing an initiation event associated with the initiation sensor and sensing an impact event associated with the at least one impact sensor. The at least one controller is further configured for determining the impact velocity estimate proportional to a temporal difference between the initiation event and the impact event, using the impact velocity estimate to determine the detonation delay, and generating the detonation event at the detonation delay after the impact event.

Another embodiment of the present invention comprises a fuze for an explosive projectile including a housing, a safety and arming module disposed within the housing, and a detonation timing apparatus disposed within the housing. The safety and arming module is configured for enabling and initiating detonation of the explosive projectile at the time of a detonation event. The detonation timing apparatus comprises an initiation sensor, at least one impact sensor, and at least one controller. The at least one controller is configured for sensing an initiation event associated with the initiation sensor and sensing an impact event associated with the at least one impact sensor. The at least one controller is further configured for determining an impact velocity estimate proportional to a temporal difference between the initiation event and the impact event, using the impact velocity estimate to determine a detonation delay, and generating the detonation event for the safety and arming module at the detonation delay after the impact event.

Another embodiment of the present invention comprises an explosive projectile including an encasement, an explosive material disposed within the encasement configured for detonation, and a fuze disposed within the encasement. The fuze comprises a housing, a safety and arming module disposed within the housing, and a detonation timing apparatus disposed within the housing. The safety and arming module is configured for enabling and initiating detonation of the explosive projectile at the time of a detonation event. The detonation timing apparatus comprises an initiation sensor, at least one impact sensor, and at least one controller. The at least one controller is configured for sensing an initiation event associated with the initiation sensor and sensing an impact event associated with the at least one impact sensor. The at least one controller is further configured for determining an impact velocity estimate proportional to a temporal difference between the initiation event and the impact event, using the impact velocity estimate to determine a detonation delay, and generating the detonation event for the safety and arming module at the detonation delay after the impact event.

Yet another embodiment in accordance with the present invention comprises a method of determining a detonation time of an explosive projectile, comprising sensing an initiation event, and sensing an impact event. The method further comprises determining an impact velocity estimate proportional to a temporal difference between the initiation event and the impact event. Using the impact velocity estimate, the method further comprises determining a detonation delay correlated to the impact velocity estimate, and generating a detonation event at the detonation delay after the impact event.

BRIEF DESCRIPTION OF THE DRAWINGS

In the drawings, which illustrate what is currently considered to be the best mode for carrying out the invention.

DETAILED DESCRIPTION OF THE INVENTION

In the following description, circuits and functions may be shown in block diagram form in order not to obscure the present invention in unnecessary detail. Conversely, specific circuit implementations shown and described are exemplary only and should not be construed as the only way to implement the present invention unless specified otherwise herein. Additionally, block definitions and partitioning of logic between various blocks is exemplary of a specific implementation. It will be readily apparent to one of ordinary skill in the art that the present invention may be practiced by numerous other partitioning solutions. For the most part, details concerning timing considerations and the like have been omitted where such details are not necessary to obtain a complete understanding of the present invention and are within the abilities of persons of ordinary skill in the relevant art.

In this description, some drawings may illustrate signals as a single signal for clarity of presentation and description. It will be understood by a person of ordinary skill in the art that the signal may represent a bus of signals, wherein the bus may have a variety of bit widths and the present invention may be implemented on any number of data signals including a single data signal.

The terms "assert" and "negate" are respectively used when referring to the rendering of a signal, status bit, or similar apparatus into its logically true or logically false state. Accordingly, if a logic level one or a high voltage represents an asserted state (i.e., logically true), a logic level zero or a low voltage represents the negated state (i.e., logically false). Conversely, if a logic level zero or a low voltage represents the asserted state, a logic level one or a high voltage represents the negated state.

In describing the present invention, the systems and elements surrounding the invention are first described to better understand the function of the invention as it may be implemented within these systems and elements.

Figure 1:
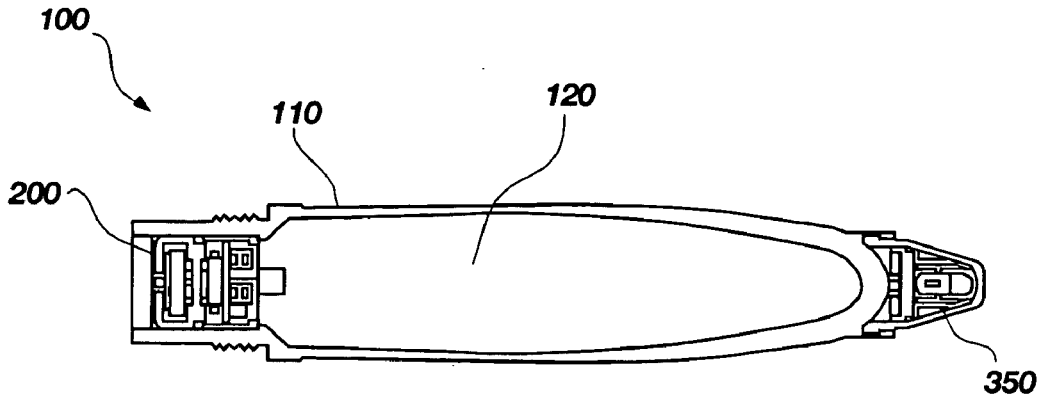
FIG. 1 is a diagram of an exemplary explosive projectile incorporating the present invention.

FIG. 1 illustrates an exemplary embodiment of an explosive projectile 100 (also referred to as a warhead) incorporating the present invention. As illustrated in FIG. 1, the explosive projectile 100 includes a fuze 200 in the base 210 and an explosive material 120 encased by a body 110. Additionally, the nose may include impact sensors 350, such as, for example, a crush sensor, and a graze sensor. The FIG. 1 explosive projectile 100 is exemplary only, it will be readily apparent to a person of ordinary skill in the art that the present invention may be practiced or incorporated into a variety of explosive projectiles as described earlier.

Figure 2:
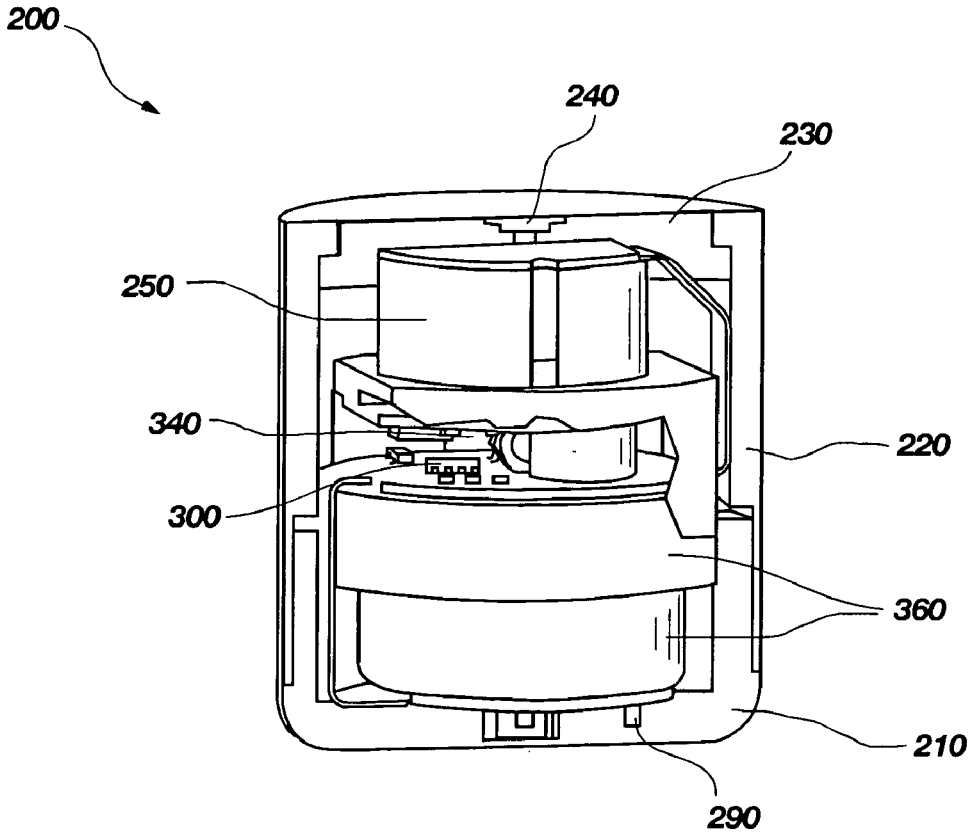
FIG. 2 is a cut-away three-dimensional view of an exemplary fuze incorporating the present invention.

FIG. 2 illustrates an exemplary embodiment of the fuze 200 incorporating the present invention. As illustrated in FIG. 2, the exemplary fuze 200 includes elements forming an encasement for the fuze 200 including a base 210, a housing 220, and an end cap 230. The functional elements within the encasement include a lead charge 240, a safety and arming module 250 (S&A module), a communication interface 290, an electronics module 300, and a spin sensor 360. In the exemplary embodiment illustrated in FIG. 1, the fuze 200 is mounted in the aft end of the explosive projectile 100. The aft location places the fuze 200 within the "buried" warhead section adjacent to the rocket motor/guidance section, which is a relatively ineffective location for fragmentation and is well suited for the fuze 200. In addition, this location prevents the fuze 200 from interfering with forward fragmentation and allows an unobstructed forward target view for other sensors, such as, for example, proximity sensors. However, while the aft location is used in the exemplary embodiment of FIG. 1, other locations and configurations are contemplated within the scope of the invention.

As explained earlier, part of the S&A function is to prevent premature detonation. The exemplary embodiment incorporates two independent environmental criterion to determine that the explosive projectile 100 may be safely armed. As a further safeguard, an intent to launch signal may be used. In the exemplary embodiment, the intent to launch signal may be supplied by a trigger pull, which begins a messaging process explained more fully below.

The first environmental criterion used to enable arming is an axial acceleration magnitude and duration profile. This first environmental criterion is sensed, in the exemplary embodiment, by the S&A module 250 using a conventional mechanical function. At launch, the S&A module 250 mechanically compares the launch acceleration magnitude/duration to an acceptable threshold, if the threshold is achieved, the first environmental criterion is satisfied and the fuze 200 is mechanically arm enabled.

This mechanical arm enabling places the S&A module 250 in a state wherein the second environmental criterion may be verified. Verification of the second environmental criterion causes activation of a piston actuator 379 (explained below), which mechanically aligns an explosive train. With the explosive train aligned, the explosive projectile 100 is armed and prepared for detonation.

In this exemplary embodiment, the second environmental criterion is related to spin about the longitudinal axis of the explosive projectile 100. A spin profile, comprising information about the spin environmental criterion may be developed. In the exemplary embodiment shown in FIG. 3, an alternator coupled to an inertial mass may be used as the spin sensor 360. The alternator and inertial mass combination may detect rotation of the alternator relative to the inertial mass. The relative motion may generate an alternating current signal (referred to as a spin signal 365). The spin signal 365 may be processed to develop an actual spin profile, which may be compared to an acceptable spin profile to determine if the spin signal 365 conforms to expectations of normal flight of the explosive projectile 100. Acceptable spin profiles may be developed from modeling or empirical testing and analysis of the explosive projectile 100. The actual spin profile and the acceptable spin profile may include a variety of parameters, such as, for example, revolution count, spin rate, increase in spin rate, and spin signal amplitude.

By way of example, a spin profile may comprise at least four full rotations detected by the spin sensor 360, with each successive rotation occurring at an increasing rate. If the required spin profile is not verified within an expected time window, the fuze 200 may be shut down.

Of course, other conventional methods of detecting spin in an explosive projectile are contemplated within the scope of the present invention. In addition, while the exemplary embodiment uses the two environmental criteria of acceleration and spin, other environmental criteria may be used in the present invention. Furthermore, a single environmental criterion, or more than two environmental criteria, may also be used in practicing the present invention.

Figure 3:
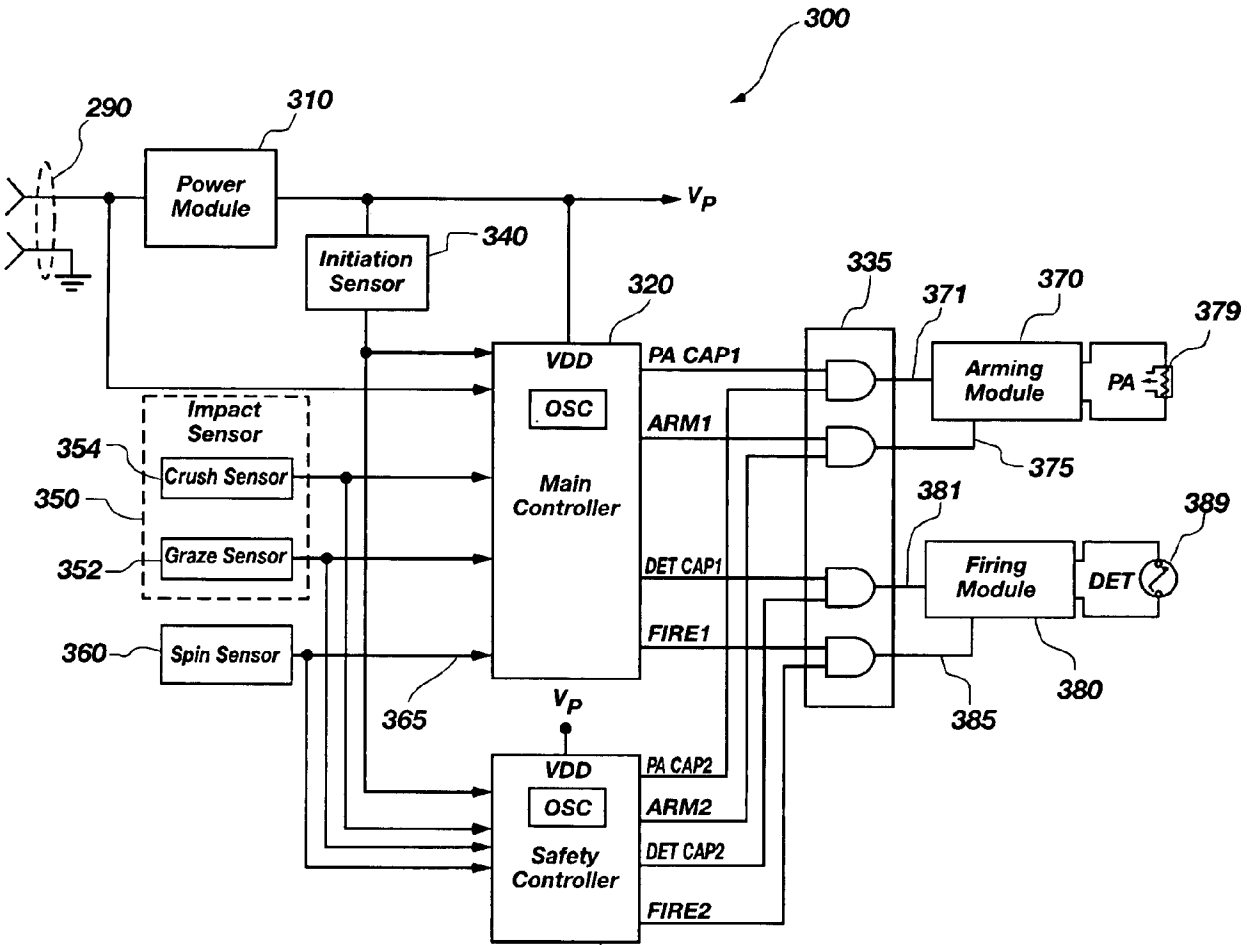
FIG. 3 is a block diagram of an exemplary detonation control apparatus according to the present invention.

Impact sensors 350 as shown in FIG. 3 may include the crush sensor 354 and the graze sensor 352. These impact sensors may be located in a crush assembly at the nose of the explosive projectile 100 as shown in FIG. 1. By way of example and not limitation, the crush sensor 354 may be implemented as sensors suitable for sensing a substantial reduction in velocity, such as accelerometers, and a conventional crush switch. The graze sensor 352 may be implemented as a conventional graze switch. In addition, by way of example and not limitation, the graze sensor may also be implemented as a sensor, or sensors, configured for detecting a side directed acceleration (i.e., an acceleration in a direction other than the axis of the direction of flight), such as at least one accelerometer. These type of sensors may detect a ricochet effect on the explosive projectile. A combination of the crush sensor 354 and the graze sensor 352 may provide rapid response to target impact regardless of impact/graze angle. The impact sensor 350 signals may connect to the electronics module 300 in the fuze 200 through any suitable electrical connection means, such as, for example, a ribbon cable or a flex cable coupled to a connector of the electronics module 300.

An exemplary embodiment of the electronics module 300 is shown in FIG. 3. The exemplary electronics module 300 of FIG. 3 comprises a main controller 320, a safety controller 330, a power module 310, an arming module 370, a firing module 380, and a voting module 335. The exemplary embodiment employs redundant low power microcontrollers as the main controller 320 and the safety controller 330. In the exemplary embodiment, the safety controller 330 is a different part from a different vendor than that of the main controller 320. The dual-controller configuration using differing parts enables a cross-checking architecture, which may eliminate both single point and common mode failures. However, other controller configurations are contemplated within the scope of the present invention. For example, a single controller may be used, or more than two controllers may be used to enable additional redundancy and safeguards against failures.

In the exemplary embodiment of FIG. 3, the voting module 335 includes AND gates to logically combine control signals from the main controller 320 and safety controller 330. Each controller 320 and 330 generates four signals for controlling arming and firing of the explosive projectile 100. The logic gates combine the arming and firing control signals to only enable arming and firing if both the main controller 320 and safety controller 330 have arrived at the same solution and both have generated the control signal in question. Specifically, if both the PA_CAP1 signal and the PA_CAP2 signal are asserted, then a piston actuator capacitor signal 371 is asserted. If both the ARM1 signal and the ARM2 signal are asserted, then an arm signal 375 is asserted. If both the DET_CAP1 signal and the DET_CAP2 signal are asserted, then a detonation capacitor signal 381 is asserted. If both the FIRE1 signal and the FIRE2 signal are asserted, a fire signal 385 is asserted. It will be readily apparent to a person of ordinary skill in the art that the voting module 335 may be implemented in many forms, such as, for example, wire ANDing the signals or wire ORing asserted low signals. In addition, the voting module 335 may not be needed in an embodiment including only one controller. Similarly, the voting module 335 may desirably be more complex in embodiments including more than two controllers.

An initiation sensor 340 may be included with the electronics module 300 or may be located in another position within the fuze 200 or explosive projectile 100 and connected to the electronics module 300 through suitable wiring and connectors. The initiation sensor 340 may be a type of sensor that detects a launch event, such as, for example, an acceleration switch or accelerometer.

Other elements shown in FIG. 3 are the spin sensor 360 and at least one impact sensor 350. The at least one impact sensor 350 connects to the electronics module 300 as explained earlier. The spin sensor 360, which may be located in the fuze 200, also connects to the electronics module 300 through suitable wiring and, if desirable, a suitable connector.

Figure 4:
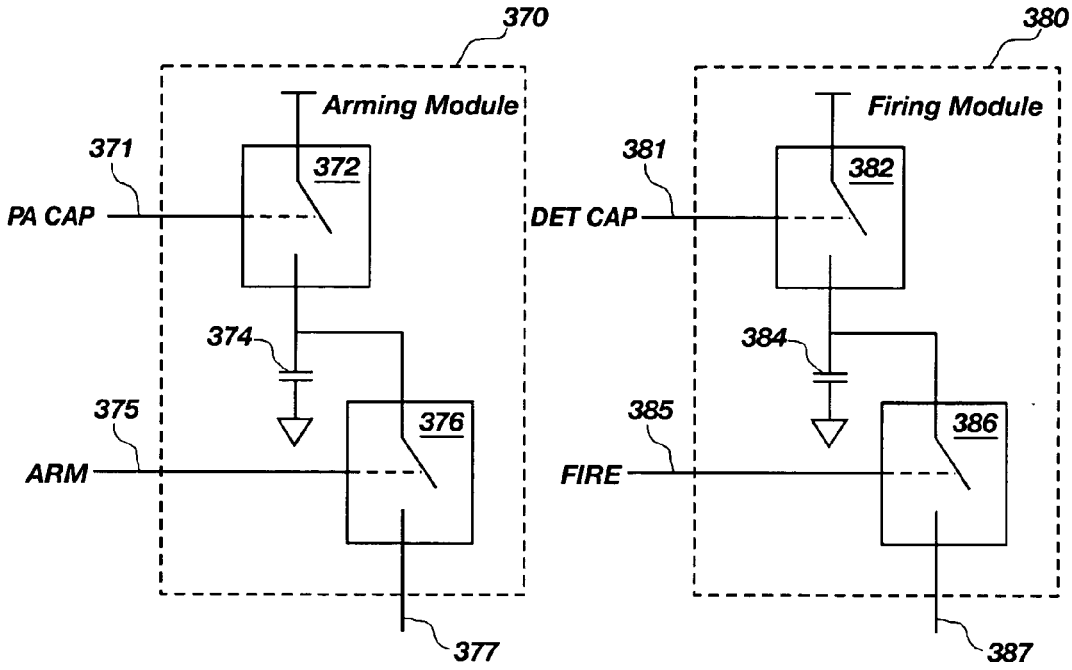
FIG. 4 is an exemplary circuit for controlling arming and detonation signals in accordance with the present invention.

Exemplary embodiments of the arming module 370 and the firing module 380 are shown in FIG. 4. In the exemplary arming module 370, the piston actuator capacitor signal 371 controls a first electronic switch 372. When the piston actuator capacitor signal 371 is asserted, the first electronic switch 372 closes allowing the power source to charge an arm capacitor 374. The arm signal 375 controls a second electronic switch 376. If the arm signal 375 is asserted, the second electronic switch 376 closes, allowing the voltage on the arm capacitor 374 to assert a piston actuator signal 377 to control a piston actuator 379 (shown in FIG. 3).

In the exemplary firing module 380, the detonation capacitor signal 381 controls a third electronic switch 382. When the detonation capacitor signal 381 is asserted, the third electronic switch 382 closes, allowing the power source to charge a fire capacitor 384. The fire signal 385 controls a fourth electronic switch 386. If the fire signal 385 is asserted, the fourth electronic switch 386 closes, allowing the voltage on the fire capacitor 384 to assert a detonate signal 387 to control a detonation switch 389 (shown in FIG. 3).

Detonation modes and methods of determining a suitable detonation time are predominant features of the present invention. At least two detonation modes may be selected by a user prior to launch. These two modes are a point detonation mode (PD mode) and a Velocity Variable Delay detonation mode (VVD detonation mode).

In point detonation mode, the explosive projectile 100 is triggered to detonate at the time of impact, or a fixed delay after impact. As part of the fixed delay after impact, various delays may be used from "super quick," or almost instantaneous, to any desired delay value. This fixed delay may be pre-programmed in the firmware of the electronics module 300, possibly based on target lethality studies. In addition, a third operation mode may be added such that the fixed delay to be used after impact is user selectable prior to launch.

In VVD detonation mode, the explosive projectile 100 is triggered to detonate a time period after impact (referred to as a detonation delay 445). However, unlike the fixed delay after detonation, the detonation delay 445 in VVD mode is derived from an impact velocity estimate. This mode enables the explosive projectile 100 to detonate at approximately the same location within the target regardless of variations in impact velocity. In VVD detonation mode the delay after initial impact is autonomously derived based partially on a temporal difference between an initiation event and an impact event. The impact velocity estimate may be calculated by combining the temporal difference with a knowledge of velocity as a function of time and other environmental parameters, such as, for example, projectile ballistic characteristics, propellant characteristics, launch characteristics, and target characteristics.

The VVD detonation mode provides the accurate impact velocity estimate and uses the estimate to determine an optimum time delay until impact. This time delay determination may be optimized during development for maximum effectiveness against various targets. Determining detonation time as a function of the impact velocity estimate enables optimizing the penetration delay of the explosive projectile 100 without changing fuze 200 setting schemes to include a variety of delay time settings based only on time of flight information. In addition, to add additional flexibility, the delay function may be partially user selectable, such that a user may select a relative delay which is incorporated into the VVD detonation mode time delay calculations. For example, the user may be able to select between short, long, or very long VVD detonation modes.

Figure 5:
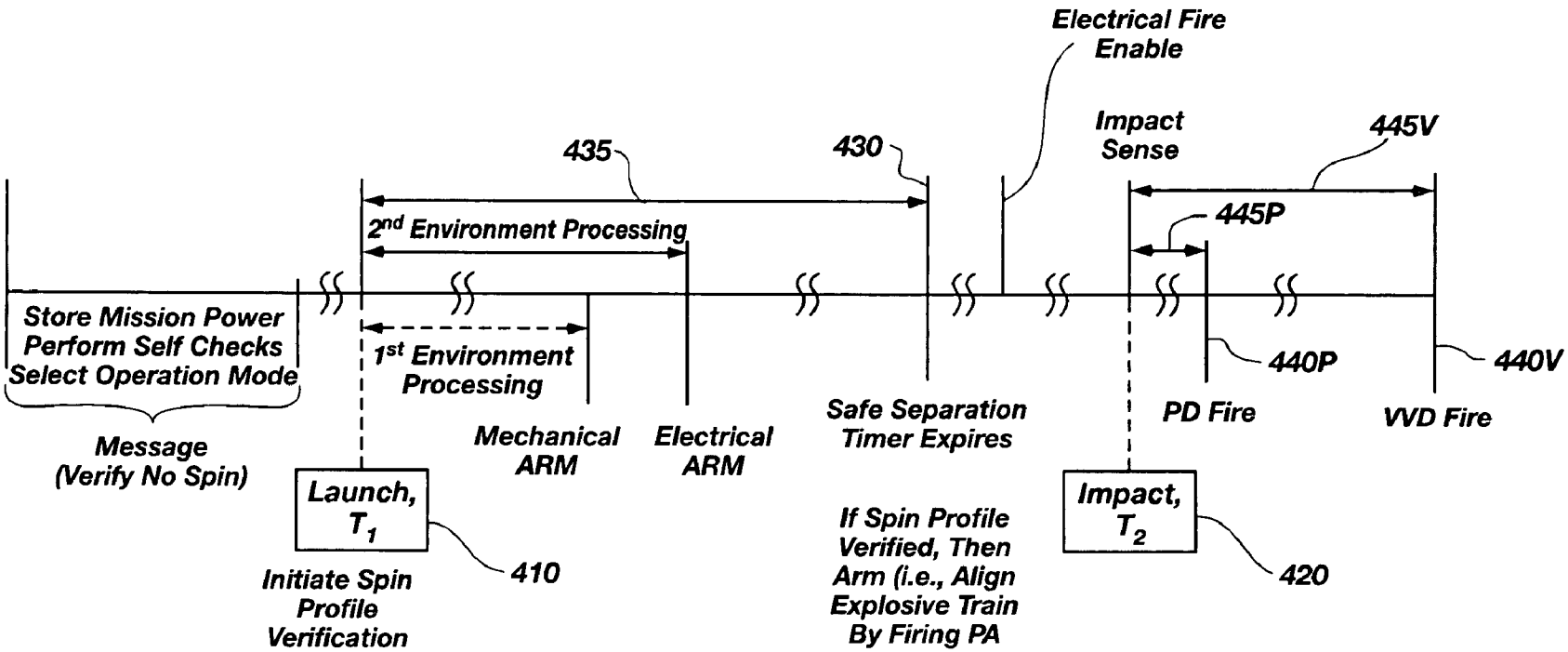
FIG. 5 is a time line diagram illustrating events of interest prior to detonation of an explosive projectile incorporating the present invention.

In operation, the timeline illustrated in FIG. 5 along with the block diagrams of FIG. 3 and FIG. 4 may be used to describe overall function of this exemplary embodiment of the present invention. A potential launch may begin with a setter message sent from the communication interface 290 to the main controller 320 and safety controller 330 of the electronics module 300. The setter message causes the electronics module 300 to perform self-checks, and determines the operating mode based on the content of the setter message. Because the setter message includes a substantial number of voltage transitions, it may also be used by the power module 310 to generate and store power during the setter message for overall function of the electronics module 300. The power generation and storage may be performed during the setter message by a combination of signal rectifying, boost circuitry, buck circuitry, filtering, and capacitive storage as are well known in the art. In the exemplary embodiment described herein, the message process may take up to 48 ms depending on the time delay settings explained below. Alternate message processes, power generation, and power storage, or the lack thereof, are contemplated as within the scope of the invention. After completion of the message process, the fuze 200 is self-contained with its own power storage and remains idle until launch.

A launch may be triggered after completion of the message process. The launch event (also referred to as the initiation event 410) is shown in FIG. 5 as $T_1$. The initiation event 410 triggers the start of safe separation timers, begins the first environmental criterion detection process, and begins the second environmental criterion process.

As explained earlier, the first environmental criterion check determines that appropriate acceleration has been achieved and completes the mechanical arming of the fuze 200.

Within the electronics module 300, the initiation sensor 340 indicates the initiation event to the main controller 320 and the safety controller 330. In an exemplary embodiment the initiation sensor 340 may be an acceleration switch that senses the launch. The electronics module 300 uses the closure of the acceleration switch as the $T_1$ signal (i.e., initiation signal) indicating a launch event. The initiation signal starts redundant timers in both the main controller 320 and safety controller 330 to define a time window for spin profiling. In addition, a safe separation delay 435 may be programmed into the same or additional timers to determine a safe separation time 430, which provides additional safety assurance that the platform and occupants are out of harm's way when the fuze 200 is armed (i.e., safe separation distance between explosive projectile 100 and platform has been achieved).

During the safe separation delay counting, the second environmental criterion check is performed to determine that the explosive projectile 100 has achieved the acceptable spin profile. As stated earlier, acceptable spin profiles may be developed from modeling or empirical testing and analysis of the explosive projectile 100. In addition, the controllers (320 and 330) may include multiple acceptable spin profiles stored within them, enabling the proper acceptable spin profile to be selected at an appropriate time, such as, for example, as part of the message process prior to launch. Both the main controller 320 and safety controller 330 sample the spin signal 365 to create the actual spin profile. If the actual spin profile conforms to the acceptable spin profile defined in the firmware of the electronics module 300, then the second environmental criterion check is successful and the fuze 200 may be electrically armed.

By way of example, an acceptable spin profile may be defined as at least four transitions from the spin sensor 360, with each transition occurring at an increasing rate. The system may be configured such that the controllers 320 and 330 wait for a signal from the initiation sensor 340 indicating a valid launch event. After a valid launch event, the controllers 320 and 330 may sample the spin signal 365 to develop the actual spin profile. If the actual spin profile conforms to the acceptable spin profile, the controllers 320 and 330 may signal that a valid spin environment has been achieved. If the actual spin profile does not conform to the acceptable spin profile within an expected time window, a valid spin environment may have not been achieved and the fuze 200 may be shut down.

When the main controller 320 asserts the PA CAP1 signal and the safety controller 330 asserts the PA CAP2 signal, indicating that both controllers (320 and 330) have detected the acceptable spin profile (i.e., the second environmental criterion has been met), the PA CAP signal is asserted. The PA CAP signal closes the first electronic switch 372 so the arm capacitor 374 (shown in FIG. 4) may begin charging. At the safe separation time 430, the main controller 320 asserts the ARM1 signal and the safety controller 330 asserts the ARM2 signal. When both ARM1 and ARM2 are asserted, the arm signal 375 is asserted causing the second electronic switch 376 to close, which asserts the piston actuator signal 377 to fire the piston actuator 379. If the first environmental criterion was successfully satisfied (i.e., the S&A device is mechanically arm enabled), the S&A rotor will be driven to the armed position by the piston actuator 379. If the first environmental criterion is not satisfied, the rotor remains in the unarmed position due to mechanical locks preventing the piston actuator 379 from driving the rotor to the armed position. Firing the piston actuator 379 performs the final alignment of explosive train and the explosive projectile 100 is armed for detonation.

Subsequent to alignment of the explosive train, the main controller 320 asserts the DET CAP1 signal and the safety controller 330 asserts the DET CAP2 signal. When both DET CAP1 and DET CAP2 are asserted, the DET CAP signal closes a third electronic switch 382 so the fire capacitor 384 may charge. With the fire capacitor 384 charged the fuze 200 is electrically fire enabled (i.e., impact enabled).

FIG. 5 shows the impact event 420 as $T_2$. In the exemplary embodiment, the graze sensor 352, the crush sensor 354, or a combination of the two sensors detects impact. The controllers (320 and 330) have separate ports to distinguish graze sensing from crush sensing, allowing various combinations of crush sensing and graze sensing to determine the impact event 420. Once the impact event 420 has been determined, a detonation timer is triggered in each controller (320 and 330) to begin counting the appropriate detonation delay 445 before detonation of the explosive projectile 100. When the appropriate delay is reached, the main controller 320 and safety controller 330 may assert the FIRE1 and FIRE2 signals respectively. With both the FIRE1 signal and FIRE2 signal asserted, the fire signal 385 is asserted, which closes the fourth electronic switch 386 to assert the detonate signal 387. The detonate signal 387 causes a detonation event (440P or 440V) of the explosive projectile 100. The appropriate delay between impact and detonation is determined based on whether the fuze 200 was set to either point detonation mode or VVD detonation mode.

In point detonation mode, the detonation event 440P may be almost immediate if the explosive projectile 100 is set to detonate on impact. Alternatively, as explained earlier, a predetermined detonation delay 445P defined in firmware, or pre-selected by the user, may be used to determine the delay between the impact event 420 and the detonation event 440P.

In VVD mode, the main controller 320 and safety controller 330 each calculate the detonation delay 445V based on the impact velocity estimate as explained earlier. Based on the impact velocity estimate, the detonation delay 445V to be used by the detonation timers may be calculated. When the VVD detonation delay 445V expires in each controller (320 and 330), the VVD detonation event 440V occurs.

Although this invention has been described with reference to particular embodiments, the invention is not limited to these described embodiments. Rather, the invention is limited only by the appended claims, which include within their scope all equivalent devices or methods that operate according to the principles of the invention as described.

What is claimed is:

1. A detonation timing apparatus, comprising:

an initiation sensor;

at least one impact sensor; and at least one controller configured for:

sensing an initiation event associated with the initiation sensor;

sensing an impact event associated with the at least one impact sensor;

determining an impact velocity estimate proportional to a combination of target characteristics and a temporal difference between the initiation event and the impact event;

determining a detonation delay correlated to the impact velocity estimate; and generating a detonation event substantially at the detonation delay after the impact event.

2. The apparatus of claim 1, wherein the initiation sensor is an acceleration switch configured for sensing a launch event.

3. The apparatus of claim 1, wherein the at least one impact sensor comprises at least one of a graze sensor and a crush sensor.

4. The apparatus of claim 1, wherein determining the impact velocity estimate further comprises analyzing at least one predetermined parameter in relation to the target characteristics, the initiation event and the impact event.

5. The apparatus of claim 4, wherein the at least one predetermined parameter is selected from the group consisting of projectile ballistic characteristics, propellant characteristics, and launch characteristics.

6. The apparatus of claim 1, further comprising a communication interface operably coupled with the at least one controller; and the at least one controller is further configured for receiving a command from the communication interface prior to the initiation event, the command indicating that the detonation event is to be generated in one of a point detonation mode and a velocity variable delay detonation mode.

7. The apparatus of claim 6, wherein the point detonation mode comprises generating the detonation event at a predetermined detonation delay after the impact event.

8. The apparatus of claim 7, wherein the predetermined detonation delay is substantially near zero.

9. The apparatus of claim 6, wherein the velocity variable delay detonation mode comprises generating the detonation event after the impact event at a detonation delay correlated to the impact velocity estimate.

10. The apparatus of claim 1, further comprising:

an arming module; and a spin sensor configured for sensing a rotation of the detonation timing apparatus about an axis and generating a spin signal proportional to the rotation; and wherein the at least one controller is further configured for:

sampling the spin signal between the initiation event and a safe separation time to develop an actual spin profile; and enabling the arming module if the actual spin profile conforms to an acceptable spin profile.

11. The apparatus of claim 10, wherein the arming module is further configured for arming an explosive projectile at the safe separation time if the arming module is enabled.

12. The apparatus of claim 11, further comprising a firing module configured for detonating the explosive projectile as a result of the detonation event if the explosive projectile has been armed.

13. The apparatus of claim 10, wherein the acceptable spin profile and the actual spin profile incorporate at least one spin parameter selected from the group consisting of revolution count, spin rate, increase in spin rate, and spin signal amplitude.

14. The apparatus of claim 10, wherein the safe separation time occurs at a safe separation delay after the initiation event.

15. The apparatus of claim 1, wherein the at least one controller comprises a plurality of controllers.

16. The apparatus of claim 15, wherein at least two of the plurality of controllers are different types of controllers.

17. The apparatus of claim 15, further comprising a voting module, the voting module configured for generating an arming event if each controller of the plurality of controllers generates an arm signal.

18. The apparatus of claim 17, wherein the voting module is further configured for generating the detonation event if each controller of the plurality of controllers generates a fire signal.

19. A fuze for an explosive projectile, comprising:

a housing;

a detonation timing apparatus disposed within the housing, comprising:

an initiation sensor;

at least one impact sensor; and at least one controller configured for:

sensing an initiation event associated with the initiation sensor;

sensing an impact event associated with the at least one impact sensor;

determining an impact velocity estimate proportional to a combination of a target characteristic and a temporal difference between the initiation event and the impact event;

determining a detonation delay correlated to the impact velocity estimate; and generating a detonation event substantially at the detonation delay after the impact event; and a safety and arming module disposed within the housing and configured for enabling and initiating detonation of the explosive projectile responsive to the detonation event.

20. An explosive projectile, comprising:

an encasement;

an explosive material disposed within the encasement and configured for detonation; and a fuze disposed within the encasement, comprising:

a housing;

a detonation timing apparatus disposed within the housing, comprising:

an initiation sensor;

at least one impact sensor; and at least one controller configured for:

sensing an initiation event associated with the initiation sensor;

sensing an impact event associated with the at least one impact sensor;

determining an impact velocity estimate proportional to a combination of a target characteristic and a temporal difference between the initiation event and the impact event;

determining a detonation delay correlated to the impact velocity estimate; and generating a detonation event substantially at the detonation delay after the impact event; and a safety and arming module disposed within the housing and configured for enabling and initiating detonation of the explosive material responsive to the detonation event.

21. A method of determining a detonation time of an explosive projectile, comprising:

sensing an initiation event;

sensing an impact event;

determining an impact velocity estimate proportional to a combination of a target characteristic and a temporal difference between the initiation event and the impact event;

determining a detonation delay correlated to the impact velocity estimate;

generating a detonation event substantially at the detonation delay after the impact event.

22. The method of claim 21, wherein the initiation event is determined by sensing a launch event using an acceleration sensor.

23. The method of claim 21, wherein the impact event is sensed by at least one of a graze sensor and a crush sensor.

24. The method of claim 21, wherein determining the impact velocity estimate further comprises analyzing at least one predetermined parameter in relation to the target characteristics, the initiation event, and the impact event.

25. The method of claim 24, further comprising selecting the at least one predetermined parameter from the group consisting of projectile ballistic characteristics, propellant characteristics, and launch characteristics.

26. The method of claim 21, wherein determining the detonation delay further comprises receiving a command from a communication interface prior to the initiation event indicating that the detonation event is to be generated in one of a point detonation mode and a velocity variable delay detonation mode.

27. The method of claim 26, wherein generating the detonation event in the point detonation mode comprises generating the detonation event at a predetermined detonation delay after the impact event.

28. The method of claim 27, further comprising selecting the predetermined detonation delay to be substantially near zero.

29. The apparatus of claim 26, wherein generating the detonation event in the velocity variable delay detonation mode comprises generating the detonation event after the impact event at a detonation delay correlated to the impact velocity estimate.

30. The method of claim 21, further comprising detonating an explosive projectile responsive to the detonation event.

31. The method of claim 21, further comprising:

generating a spin signal proportional to rotation of the explosive projectile about an axis;

determining an actual spin profile by sampling the spin signal between the initiation event and a safe separation time; and arming the explosive projectile at the safe separation time if the actual spin profile conforms to an acceptable spin profile.

32. The method of claim 31, further comprising detonating the explosive projectile responsive to the detonation event if the explosive projectile has been armed.

33. The apparatus of claim 31, wherein the acceptable spin profile and the actual spin profile incorporate at least one spin parameter selected from the group consisting of revolution count, spin rate, increase in spin rate, and spin signal amplitude.

34. The method of claim 31, wherein the safe separation time occurs at a safe separation delay after the initiation event.

35. The method of claim 21, wherein the acts of determining the impact velocity, determining the detonation delay, and generating the detonation event are performed by at least one controller.

36. The method of claim 35, further comprising selecting the at least one controller to comprise a plurality of controllers.

37. The method of claim 36, further comprising selecting at least two of the plurality of controllers to be different types of controllers.

38. The method of claim 36, further comprising generating an arming event if all the controllers of the plurality of controllers generate an arm signal.

39. The method of claim 38, further comprising generating the detonation event if all the controllers of the plurality of controllers generate a fire signal.

* * * * *